United States Patent [19]

Nilssen

[11] Patent Number: 4,612,473

[45] Date of Patent: Sep. 16, 1986

[54] INCANDESCENT LAMP WITH DICHROIC TRIHEDRAL CORNER REFLECTORS

[76] Inventor: Ole K. Nilssen, Caesar Dr., Rte. 5, Barrington, Ill. 60010

[21] Appl. No.: 632,120

[22] Filed: Jul. 18, 1984

[51] Int. Cl.[4] ..... H01J 5/16; H01J 61/40

[52] U.S. Cl. ..... 313/111; 313/113

[58] Field of Search ..... 313/111, 112, 113, 579

[56] References Cited

U.S. PATENT DOCUMENTS

| | | | |
|---|---|---|---|
| 2,102,975 | 12/1937 | Rolph | 313/111 |
| 3,309,554 | 3/1967 | Lorenzo | 313/113 |
| 4,039,878 | 8/1977 | Eijkelenboom et al. | 313/113 |
| 4,331,901 | 5/1982 | de Vrijer et al. | 313/113 |

*Primary Examiner*—Davis L. Willis

*Assistant Examiner*—William L. Oen

[57] ABSTRACT

A dichroically reflect/transmit disc is comprised of multiple small trihedral dichroic corner-reflectors and is positioned near an incandescent filament in such a way as to intercept a substantial part of the light emitted therefrom. The dimension of each reflective/transmissive surface of each individual corner-reflector is small in comparison with the width of the filament. Each reflective/transmissive surface reflects light of infrared frequencies, but transmits light of visible frequencies with minimal attenuation. Thus, infrared light is reflected back onto the filament, with the overall result of significantly improving luminous efficacy in terms of the amount of visible light obtained for a given amount of power consumed by the filament.

20 Claims, 2 Drawing Figures

INCANDESCENT LAMP WITH DICHROIC TRIHEDRAL CORNER REFLECTORS

BACKGROUND OF THE INVENTION

1. Field of Invention

The present invention relates to incandescent lamps having improved luminous efficacy and/or durability due to preventing infrared light from escaping the incandescent filament while permitting visible light to escape.

2. Description of Prior Art

Means for improving the luminous efficacy of incandescent lamps by preventing a substantial part of the infrared energy from escaping the incandescent filament, while permitting visible light to escape substantially without hindrance, have been described in numerous prior art references, such as in the following U.S. Pat. Nos. 1,425,967 to Hoffman; 1,342,894 to Bugbee; 2,859,369 to Williams et al; 4,039,878 to Eijkelenboom et al; 4,160,929 to Thorington et al; 4,283,653 to Brett; 4,366,407 to Walsh; and 4,375,605 to Fontana et al.

All these prior art means are based on using curved surfaces for selective transmission and/or reflection of the radiation coming from the incandescent filament, thereby transmitting substantially all of the visible light while reflecting back onto the filament much of the infrared light.

However, it is difficult to make the curvature of these curved surfaces, and to position the filament in relationship thereto, accurately enough to cause the reflected infrared light to hit the filament. Probably as a result of these difficulties, incandescent lamps uing dichroic reflection means for improving luminous efficacy have not found extensive application.

SUMMARY OF THE INVENTION

Objects of the Invention

A first object of the present invention is that of providing an incandescent lamp means with improved luminous efficacy and/or durability.

A second object is that of providing an incandescent lamp means wherein transmission of visible light and reflection of infrared light back onto the incandescent filament is achieved by way of a surface with multiple small trihedral dichroic corner-reflectors.

A third object is that of providing a Halogen-type incandescent lamp means wherein visible light is allowed to escape with relatively small attenuation, but wherein much of the infrared light is made to reflect back onto the incandescent filament, thereby providing for improved luminous efficacy and/or longer lamp life.

A fourth object is that of providing for a high-efficacy incandescent lamp system wherein the incandescent filament is contained within a substantially transparent glass envelope, and wherein frequency-selective light reflection and transmission means are positioned outside of this envelope and so arranged and constituted as to reflect a substantial part of the infrared light back onto the filament, while permitting transmission of most of the visible light coming therefrom.

These, as well as other important objects and advantages of the present invention will become apparent from the following description.

Brief Description

In its preferred embodiment, subject invention constitutes a low-voltage Halogen reflector lamp of the type where the incandescent filament is located within a small envelope of hard glass and where this small glass envelope is placed within a more-or-less paraboloidal reflector means in such a way as to position the incandescent filament at or near the focal point thereof. The reflector means has an aperture through which the light from the filament escapes. Covering this aperture is a reflect/transmit disc comprised of numerous small trihedral corner-reflectors, each individual corner-reflector having three mutually perpendicular flat surfaces—with each such flat surface being composed of a dichroic film on a transparent substrate, providing for specular reflection of infrared light while permitting nearly unimpeded transmission of visible light. The dimensions of each of the flat surfaces of the corner-reflectors are smaller than the width of the incandescent filament.

As is well known, a corner-reflector provides for light impinging on it to be reflected right back in the direction from which the light came, although there may be a parallel displacement of as much as the maximum width of the corner-reflector. (Hence, the desirability of keeping the dimensions of each individual corner-reflector small in comparison with the width of the filament.)

Thus, the infrared light reaching the composite corner-reflector surface will be reflected right back to its origin by way of the same route by which it came therefrom, whether directly or by one or more reflections from specular surfaces.

However, the visible light reaching the composite corner-reflector surface is permitted to escape, thereby to provide useful illumination.

DESCRIPTION OF THE PREFERRED EMBODIMENT

Details of Construction

Figure 1:
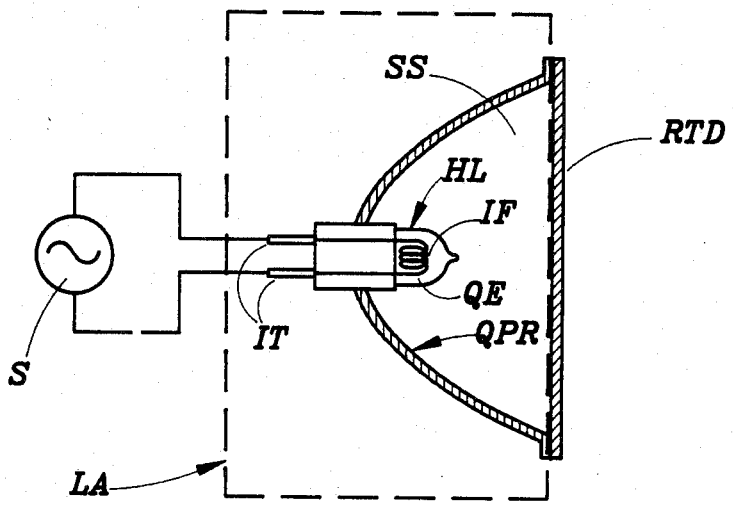
FIG. 1 schematically illustrates the preferred embodiment of the invention and shows a small Halogen lamp positioned in the focal point of a more-or-less paraboloidal reflector. Covering the aperture of this paraboloid is a flat composite reflect/transmit-disc consisting of numerous small trihedral dichroic corner-reflectors.

FIG. 1 shows a substantially ordinary reflector-type low-voltage Halogen-cycle lamp assembly LA of the type often used for photographic projection and/or track lighting purposes. This lamp assembly consists of a Halogen-cycle lamp HL that comprises an incandescent filament IF positioned within a quartz envelope QE and connected with a pair of electric input terminals IT; which input terminals are connected with a source S of 12 Volt RMS voltage.

The lamp HL is positioned within a quasi-paraboloidally-shaped reflector QPR in such a way that its filament IF is positioned at or near the focal point thereof.

A substantially flat composite reflect/transmit-disc RTD is fastened onto the aperture of the quasi-paraboloidally-shaped reflector, thereby forming a sealed space SS, the air from which is evacuated to from a partial vacuum.

Figure 2:
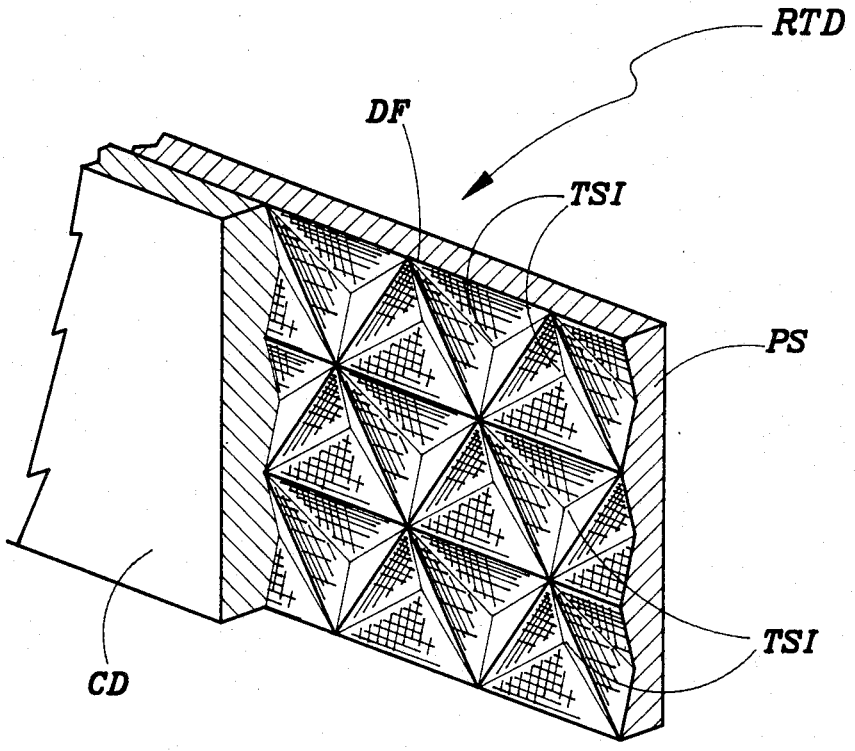
FIG. 2 illustrates details of a part of the flat composite reflect/transmit-disc.

FIG. 2 shows a detailed view of a small part of the reflect/transmit-disc; which disc consists of a plastic substrate PS into which is molded a number of trihedrally shaped impressions TSI's; which impressions are covered with a dichroic film DF. A plastic cover disc CD is molded with inverted trihedrally shaped impressions and placed in direct contact with the substrate—with its inverted impressions being fitted into the impressions of the substrate.

Description of Operation

The operation of the high-efficacy Halogen lamp system of FIG. 1 and FIG. 2 may be explained as follows.

Source S provides 12 Volt RMS to heat filament IF to incandescence. The incandescent filament emits light (or photons) of both visible and infrared frequencies. This light reflects from the mirrored walls of the paraboloidal reflector and, together with light coming directly from the filament, hits the surface of the dichroic reflect/transmit disc RTD that covers the reflector's aperture.

As illustrated in FIG. 2, the dichroic reflect/transmit disc in effect consists of a solid transparent medium within which there is embedded a large number of small trihedral corner-reflectors—with each individual flat reflect/transmit surface of these corner-reflectors consisting of a thin dichroic film adapted to reflect infrared light, but to let visible light pass through with little attenuation.

As far as visible light is concerned, the reflect/transmit disc is in effect nothing more than a clear plastic disc; which implies that there will be no substantial dispersion of any visible light passing through it.

As is well known, a trihedral corner-reflector will reflect an electromagnetic wave or a photon right back in the direction from which it came—as long as the corner-reflector is large in size compared with the wavelength of the electromagnetic wave or photon. Each of the many corner-reflectors embedded in the reflect/transmit disc, even though smaller in dimension than the width of the incandescent filament, is much larger in size than the wavelength of most of the photons emitted from the incandescent filament.

Thus, infrared photons impinging upon the reflect/-transmit disc will be reflected right back in the directions from which they came—regardless of the angle with which they strike the disc. Visible photons, on the other hand, will pass through the reflect/transmit disc substantially as if it were not there.

That is, a photon of infrared frequency coming directly from the incandescent filament to hit the reflect/-transmit disc, will be reflected directly back to the filament and hit the filament within a small distance from the very spot on the filament from which it originated. An infrared photon hitting the reflect/transmit disc by way of reflection from the mirrored surface of the paraboloidal reflector, will be reflected back to the filament by way of the paraboloidal reflector—again to hit the filament within a small distance from the very point from which it originated.

In other words, most of the infrared light emitted from the incandescent filament will be reflected by the dichroic reflect/transmit disc right back onto the filament, either directly or indirectly; whereas the visible light emitted from the filament will radiate out of the paraboloid's aperture as if there were no disc present.

By thusly conserving a substantial portion of the infrared radiation, substantially less power is needed to maintain a given filament temperature; and, as a result, the luminous efficacy is substantially improved. Conversely, the filament may be operated at a substantially lower temperature, which results in substantially increased filament operating life, yet without the reduction in luminous efficacy that normally results with lower temperature operation. Or, it is readily possible to operate somewhere in-between: with somewhat less than the attainable improvement in luminous efficacy combined with somewhat less than the attainable increase in filament life.

For a given lamp system, the choice between improved efficacy and/or increased filament life can be adjusted over a wide range by simply choosing the magnitude of the voltage provided to the filament; which is substantially equivalent to choosing the operating temperature of the filament.

Comments

It is noted that the dichroic reflect/transmit disc may be made to transmit infrared light and to reflect visible light; in which case an improved infrared heating source will result. In fact, the dichroic reflect/transmit disc may be made to selectively transmit and/or reflect any suitable bands of frequencies, thereby permitting the design of high-efficacy light sources of any desired color.

It is also noted that by having a partial vacuum in the space between the envelope of the incandescent lamp and the surface bounded by the paraboloidal reflector and the dichroic disc, heat loss by conduction and/or convection is significantly reduced. In fact, by making this partial vacuum nearly a complete vacuum, such heat loss may be substantially eliminated.

It is very important to recognize that there is no need for the reflector that partially surrounds the lamp to be paraboloidal in shape. Rather, as long as it is of specular nature, it may be of whatever shape is suitable to achieve the desired pattern of visible light. If fact, it is not even necessary to have any specular reflection surface. Instead, for instance, the lamp could be entirely surrounded by a surface of dichroic reflect/transmit medium comprising corner-reflectors.

It should also be recognized that it is not necessary that the incandescent filament (or whatever other photon source might be suitable to use) be contained within an envelope independent of the envelope effectively provided by the specular reflector and/or the dichroic trihedral-corner-reflect/transmit surface.

The size, shape and/or positioning of the photon source is of relatively little importance. In fact, there may be more than one source of photons present within an envelope comprised of a specular reflector and/or a dichroic trihedral-corner-reflect/transmit surface: the photons reflected from the dichroic trihedral-corner-reflect/transmit surface will find its way back to near the very spot from which it originated in any case.

Aside from being of reduced pressure, the gas contained within the sealed space SS may—for the purpose of reducing heat conductivity and/or corrosion, etc.—be of composition different from that of ordinary ambient air.

In situations where dispersion of the visible light is of little concern, there is no need for using the cover disc CD of FIG. 2.

Definition

The terms: (i) dichroic trihedral-corner-reflect/transmit surface, (ii) dichroic trihedral-corner-reflect/transmit surface means, (iii) dichroic trihedral-corner-reflect/transmit medium, and/or (iv) dichroic trihedral-corner-reflect/transmit disc, are all herewith defined as a surface behind which there is a collection of numerous small trihedral corner-reflectors, where each individual corner-reflector is comprised of three planes of dichroic reflector means placed in mutually perpendicular orientation—as indicated by FIG. 2.

It is believed that the present invention and its several attendant advantages and features will be understood from the preceeding description. However, without departing from the spirit of the invention, changes may be made in its form and in the construction and interrelationships of its component parts, the form herein presented merey representing the presently preferred embodiment.

I claim:

1. A lamp adapted to be powered from a source of electric power and comprising:

an incandescent filament connected with said source, said filament emitting photons of different frequencies; and reflect/transmit means composed of numerous trihedral dichroic corner-reflector means and positioned such as to intercept at least a portion of the photons emitted from the filament, said reflect/-transmit means having the property of reflecting back onto the filament photons of certain frequencies while permitting photons of other frequencies to pass through with relatively small attenuation.

2. A lamp comprising:

an incandescent filament emitting photons of different frequencies; and reflect/transmit means positioned such as to intercept a significant part of the photons emitted from the filament and characterized by reflecting right back onto the filament photons of certain frequencies and by permitting substantially unimpeded transmission of photons of certain other frequencies, the reflection of photons back onto the filament taking place in such manner that any given photon will be reflected right back to the approximate area on the filament from which it originated essentially regardless of the angle of incidence of the photons intercepted by the reflect/transmit means.

3. A lamp comprising:

source emitting photons of different frequencies;

reflect/transmit means so positioned as to intercept a substantial portion of the photons emitted from said source, said reflect/transmit means being characterized by reflecting right back to said source photons of certain frequencies, while permitting substantially unimpeded transmission of photons of certain other frequencies, the reflection right back to said source taking place essentially regardless of the angle with which photons impinge on said reflect/transmit means and in such manner that any given reflected photon will be reflected right back to the approximate area on the filament from which it originated; and structure means operative to mechanically integrate said source and said reflect/transmit means.

4. A lamp comprising:

a source emitting photons of different frequencies; and dichroic trihedral-corner-reflect//transmit surface positioned such as to intercept said photons and operative to cause photons of some frequencies to be reflected back to the source, while permitting photons of other frequencies to escape.

5. A lamp assembly comprising:

an incandescent lamp having an incandescent filament positioned within a transparent envelope and operative to emit photons of different frequencies;

a dichroic trihedral-corner-reflect/transmit surface means positioned such as to intercept a substantial portion of the emitted photons and operative to cause photons of certain frequencies to be reflected back onto the filament, while permitting photons of other frequencies to transmit through said surface means; and structure means operative to mechanically integrate said incandescent lamp and said surface means.

6. The lamp assembly of claim 5 wherein said certain frequencies are in the range of infrared light, while said other frequencies are in the range of visible light.

7. The lamp assembly of claim 5 wherein a specular reflector means is positioned such as to intercept many of the emitted photons and to reflect these onto said surface.

8. The lamp assembly of claim 5 wherein said incandescent lamp is a Halogen-cycle lamp.

9. The lamp assembly of claim 5 wherein there is a sealed space between said incandescent lamp and said surface, and wherein said sealed space contains gas of pressure and/or composition different from that of normal atmospheric air.

10. An enclosure for a source of photons, said enclosure having a boundary surface substantially enclosing said source, said enclosure comprising:

dichroic trihedral-corner-reflect/transmit surface constituting part of said boundary surface and operative to reflect at least some of the photons back to the source; and specular reflector surface constituting another part of said boundary surface.

11. An enclosure for a source of photons, said enclosure having a boundary surface substantially enclosing said source, said enclosure comprising:

dichroic trihedral-corner-reflect/transmit surface constituting at least part of said boundary surface and operative to reflect at least some of the photons back to the source.

12. The enclosure of claim 11 wherein said source comprises an electrically energized incandescent filament emitting photons of different frequencies, and wherein said dichroic trihedral-corner-reflect/transmit surface is operative to reflect photons of certain frequencies back onto this filament, while permitting photons of other frequencies to pass through.

13. The enclosure of claim 12 wherein said certain frequencies mostly represent infrared light, while said other frequencies mostly represent visible light;

whereby a significant portion of the infrared photons emitted from said incandescent filament is reflected back onto said filament, thereby reducing the amount of energy required for energizing said filament.

14. An incandescent lamp adapted to be powered from a source of electric power and comprising:

filament means adapted to connect with said source of power and operable to be heated to incandescence by power drawn therefrom;

substantially specular reflector means operable to reflect a relatively broad spectrum of light, said reflector means partly enveloping a volume of space and having an aperture;

positioning means operative to position said filament means in said space, within said aperture; and dichroic trihedral-corner-reflect/transmit surface means positioned such as to substantially cover said aperture and operative to permit relatively unimpeded transmission of light of certain frequencies and to reflect light of other frequencies, said light of other frequencies being reflected back to said filament means.

15. The incandescent lamp of claim 14 wherein said certain frequencies represent substantially visible light and where said other frequencies represent substantially infrared light.

16. An incandescent lamp assembly comprising:

an incandescent lamp having an incandescent filament contained within a transparent envelope, said incandescent filament emitting photons of different frequencies; and dichroic reflector means positioned outside of said envelope and operative to intercept at least part of the emitted photons, and to reflect intercepted photons having certain frequencies right back to the incandescent filament, while permitting photons of other frequencies to transmit through.

17. The lamp assembly of claim 16 wherein said dichroic reflector means comprises a number of individual trihedral dichroic corner-reflectors.

18. The lamp assembly of claim 17 wherein the largest dimension of one of said corner-reflectors is about equal to or smaller than the diameter of said incandescent filament.

19. The lamp of claim 4 wherein said source is characterized by having a physical shape, and wherein said trihedral-corner-reflect/transmit surface comprises a number of individual dichroic corner-reflectors, and where the largest dimension of each individual corner-reflector is similar to or smaller than the smallest dimension of said physical shape.

20. The enclosure of claim 11 wherein said source is characterized by having a physical shape, and wherein said trihedral-corner-reflect/transmit surface comprises a number of individual dichroic corner-reflectors, and where the largest dimension of each individual corner-reflector is similar to or smaller than the smallest dimension of said physical shape.

* * * * *